United States Patent [19]

Hays

[11] Patent Number: 5,014,387

[45] Date of Patent: May 14, 1991

[54] BRUSH ROLL MOUNTING

[75] Inventor: Philip G. Hays, Westlake, Ohio

[73] Assignee: The Scott Fetzer Company, Westlake, Ohio

[21] Appl. No.: 456,327

[22] Filed: Dec. 26, 1989

[51] Int. Cl.[5] ..... A47L 5/00

[52] U.S. Cl. ..... 15/339; 15/366; 15/368; 15/392

[58] Field of Search ..... 15/339, 366, 368, 392, 15/DIG. 11, 49 C, 50 C, 52.2, 50.3

[56] References Cited

U.S. PATENT DOCUMENTS

| | | | |
|---|---|---|---|
| 1,462,574 | 7/1923 | Hoover | 15/368 |
| 1,972,745 | 9/1932 | Martinet | 15/389 |
| 2,192,397 | 3/1940 | Carlson | 15/368 |
| 2,233,762 | 3/1941 | Ashbaugh | 15/368 |
| 2,336,710 | 12/1943 | Wied | 15/368 |
| 2,712,669 | 7/1955 | Frere et al. | 15/339 |
| 3,959,847 | 6/1976 | Kaulig et al. | 15/392 |
| 4,005,501 | 2/1977 | Berry | 15/339 |
| 4,361,929 | 12/1982 | Jinkins | 15/392 |
| 4,692,754 | 9/1987 | Edejer et al. | 340/671 |
| 4,728,942 | 3/1988 | England | 340/679 |

FOREIGN PATENT DOCUMENTS

| | | | |
|---|---|---|---|
| 878588 | 10/1961 | United Kingdom | 15/392 |

*Primary Examiner*—Henry J. Recla
*Assistant Examiner*—Glenn T. Barrett
*Attorney, Agent, or Firm*—Watts, Hoffmann, Fisher & Heinke

[57] ABSTRACT

A brush roll assembly for an upright vacuum cleaner having mounting blocks at each end to support the brush at different levels, to account for wear, depending on the selected angular orientation of such blocks. The blocks, while of different size to prevent improper installation end-for-end, are relatively large for convenience and performance and are configured to avoid obstruction of edgewise air flow and to avoid improper installation in an angular sense.

20 Claims, 3 Drawing Sheets

BRUSH ROLL MOUNTING

BACKGROUND OF THE INVENT

The present invention relates to improvements in floor cleaning apparatus and more particularly to an improved brush roll assemblY used in upright vacuum cleaners.

PRIOR ART

Conventional upright vacuum cleaners include a floor nozzle in which is mounted an agitator or brush roll for rotation. U.S. Pat. Nos. 4,692,754 and 4,728,942 disclose examples of a brush roll assembly that includes a rotary magnet that energizes a sensing coil in the nozzle to give an indication of proper operation. The magnet/sensor arrangement, since it is self-contained in the nozzle, has particular advantage in the type of cleaner construction in which the nozzle is separable from the power plant. The magnet/sensor arrangement, for reliable operation, requires close and accurate positioning of the brush roll mounted magnet relative to the sensor. The relative positioning of the magnet element is particularly critical where the brush roll is adjustable in the nozzle to make up for bristle wear. It is known from U.S. Pat. Nos. 1,462,574, 1,972,745, 2,192,397, 2,233,762, 2,336,710 and 4,005,501, for example, to mount a brush roll on eccentric blocks so that the height of the brush roll can be selectively adjusted by choosing one of a plurality of possible orientations of the mounting blocks in associated receiving pockets or zones in the floor nozzle. It is also known to provide a brush roll assemblY that carries a coil energization magnet, is adjustable by means of screws carried on relatively small axial projections at each of its ends, and has such end projections of different size to prevent end-for-end misalignment of the brush roll in a rug plate attached to a floor nozzle.

SUMMARY OF THE INVENTION

The invention provides a brush roll mounting system for an upright vacuum cleaner that is conveniently adjustable by the user, compatible with a self-energized rotation indicator, avoids improper assembly in the cleaner nozzle, reduces noise and promotes efficient nozzle edge cleaning. The brush roll mounting system of the invention employs a pair of mounting blocks, one on each end of the roll, that are received in associated channels in the interior of the rug nozzle. Each block has a polygonal profile that is bounded by a square and carries a brush roll bearing eccentrically of the geometric center of this profile square. The blocks are of different size so that with appropriately sized rug nozzle receiving channels the brush roll assembly cannot be improperly assembled end-for-end. This feature assures that the drive belt is received at the proper axial location and that the rotating magnetic element of the rotation sensor is located at the proper side of the rug nozzle.

The vertical position of the brush roll in the nozzle is determined by orientation of the blocks in the receiving channels. The eccentricity of the bearing center is arranged such that the rotating and stationary elements of the rotation sensor are sufficiently close to one another in all operating positions of the mounting blocks for reliable service. In the disclosed embodiment, the mounting blocks have three operating positions corresponding to three of the sides of the profile square of the blocks. These operating positions present the rotating magnetic element to the stationary rotation sensor at similar moderate distances for consistent operation. A fourth position, corresponding to the fourth side of the profile square, could result in a dangerously close spacing between the rotating and stationary sensing elements particularly if significant wear existed in the bearing surfaces. Accordingly, this position is not used and, as disclosed, at least one of the mounting blocks is provided with a unique configuration which avoids inadvertent misassembly into this position. The three operating positions are visually identified with suitable indicia to guide the user in selection of the appropriate brush position.

The abilitY of the vacuum cleaner to clean surfaces at the sides of the rug nozzle is especially important. The rotation sensor, typically, is located towards one end of the brush roll and its presence can require a local absence of bristles to avoid interference and/or wear on the stationary element of the rotation sensor. This makes it particularly important to avoid restrictions in free air flow in the rug nozzle side areas. It is desirable to construct the mounting blocks of a non-metallic vibration absorbing material such as rubber or plastic to reduce operating noise. In general, the durability and vibration absorbing capacity of the mounting blocks, especially when fabricated of conventional non-metallic materials, is increased when they are of relatively large size. Further, a large mounting block is of a convenience to the user of the vacuum cleaner since large blocks can be more readilY seen and manipulated into associated receiving channels.

Inherently, there is a conflict between obtaining satisfactorY rug nozzle edge cleaning performance and utilizing relatively large size brush roll mounting blocks since the mounting blocks potentially can obstruct free air flow in the end regions of the nozzle. The present invention overcomes this dilemma by proportioning the blocks to be received in channels that are tilted to the rear of the cleaner with increasing distance from the lower face of the rug nozzle. In accordance with an important aspect of the invention, a mounting block of maximum or near maximum size is afforded and, at the same time, unnecessary restriction of air flow is avoided by truncating certain marginal zones of the block so as to depart from a true straight side of an associated square profile. A related feature of the invention is a mounting block profile that resists incorrect assembly in the receiving channel in a position where because of eccentricities of the bearing centers the rotating element of the rotation sensor may operate too close to the stationary element.

BRIEF DESCRIPTION OF THE DRAW

Figure 12A:
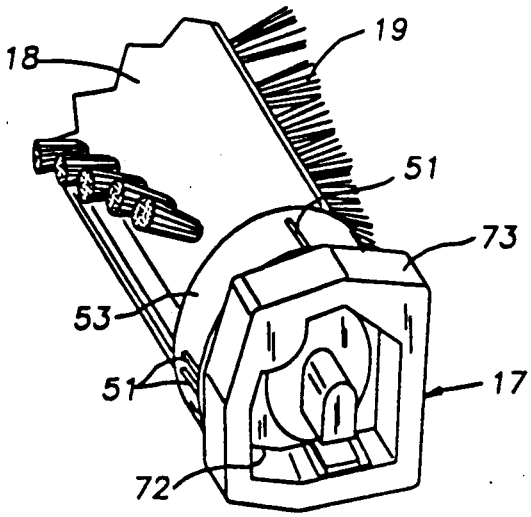
Figure 12B:
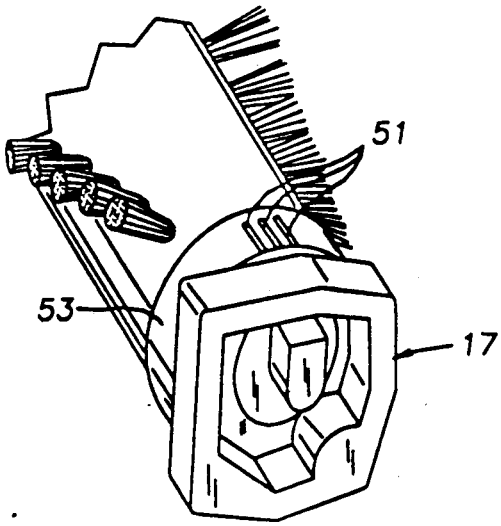

FIG. 12*a* is an enlarged perspective view of one end of the brush roll assembly showing position indicator means thereon; and FIG. 12*b* is an enlarged perspective view of the end of the brush roll assembly showing additional position identifying indicia.

DESCRIPTION OF THE PREFERRED EMBODIMENT

Figure 1:
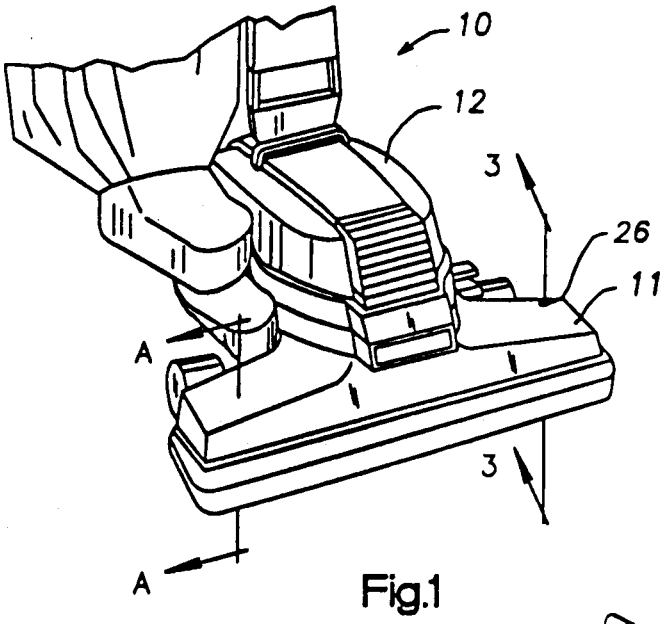
FIG. 1 is a perspective view of a rug nozzle of an upright vacuum cleaner employing the present invention.

There is illustrated in FIG. 1 an upright vacuum cleaner 10 of a generally known type in which a rug or floor nozzle 11 is separable from a power plant motor housing 12. A brush roll assembly 13 constructed in accordance with the present invention is mounted within the nozzle 11. The brush roll assembly 13 comprises a brush roll or agitator 14 rotationally mounted on a block 16, 17 at each of its ends. The brush roll 14 has a rigid body 18 of wood, plastic or other suitable material and radially oriented bristles 19 disposed along its lenGth. Preferably the body 18 is cylindrical and has a central region 21, devoid of bristles, to frictionally receive a drive belt (not shown) operated by the motor of the vacuum cleaner in a known manner. The brush roll body 18 has adjacent one of its ends a permanent magnet 22 projecting slightly from its periphery. The magnet 22 is retained in a fixed position on the body 18 by a plastic ring 23 encircling the body. When the brush roll assembly 13 is properly positioned in the nozzle, the magnet 22 and a sensor 24 (FIG. 3) lie in a common plane that is perpendicular to the axis of the brush roll assembly. The magnet 22 and sensor 24 follow the teachings of aforementioned U.S. Pat. Nos. 4,692,754 and 4,728,942, the disclosures of which are incorporated herein by reference. When the brush roll body 18 rotates, the magnet 22 sweeps past a coil of the sensor 24 to generate electrical energy that activates a light bulb or emitter 26 indicating to the user that the brush roll is properly operating.

In the illustrated embodiment, the brush roll body 18 is rotationally supported on bearings 27 adjacent each of its ends. Each of the bearings 27 is journalled on a shaft 28 that passes through them and a central clearance bore 29 in the brush roll body 18. The shaft 28 has each of its ends fixed by pins, for example, to the brush roll mountinq blocks 16, 17. While only the bearing associated with the block 16 is shown, it will be understood that the bearing support structure at the opposite end of the brush roll body 18 is essentially the same. It can be seen that through the medium of the shaft 28 and bearings 27, the blocks 16, 17 rotationally support their respective ends of the brush roll body 18. The shaft 28, being pinned to both blocks 16, 17 angularlY aligns one block to the other with reference to the axis of the shaft 28 and therefore the brush roll 14.

The mounting blocks 16, 17 are received in channels 31, 32 integrally cast or molded into the interior of the rug nozzle 11. These receiving channels 31, 32 each include parallel bars 33, 34 and 35, 36 and a stop bar 37 and 38. Parallel surfaces 41, 42 and 43, 44 confront each other and lie in planes that tilt rearwardly with increasing distance from a bottom plane or face 46 of the rug nozzle 11. The planes of the bar surfaces 41, 42 are parallel to the planes of the bar surfaces 43, 44 on the opposite side or end of the rug nozzle. The mounting block 16 associated with the magnet 22 is visually perceptively smaller than the other mounting block 17. Each pair of confronting bar faces 41, 42 and 43, 44 is spaced a distance corresponding to the size of the respective mounting block so that they receive and cradle the respective mounting block with limited clearance and so that the brush roll assembly 13 cannot be misassembled end-for-end in the nozzle.

As the vacuum cleaner is used and normal wear of the brush roll bristles 19 occurs, the blocks 16, 17 allow the axis of the brush roll 14 to be moved closer to the rug nozzle bottom face 46 to maintain the brush roll in contact with a floor surface for high cleaning efficiency. More specifically, the mounting blocks 16, 17 support the brush roll in a plurality of selectively adjustable positions depending on the angular orientation of the blocks 16, 17 with reference to the horizontal axis of the brush roll.

Figure 2:
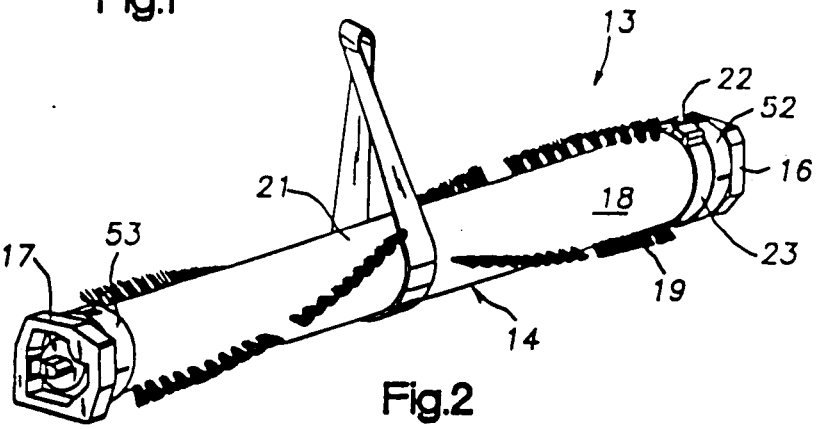
FIG. 2 is a perspective view of a brush roll assembly embodying the present invention.
Figure 4:
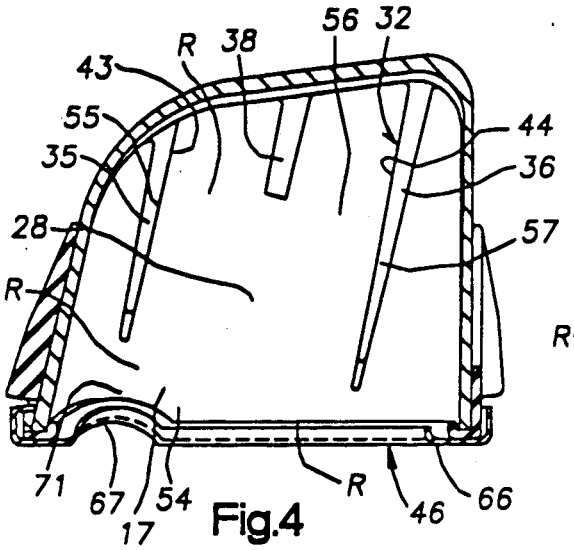
FIG. 4 is a view taken in the plane A—A of FIG. 1 showing one end of the brush roll assembly in a first operational position of adjustment.
Figure 5:
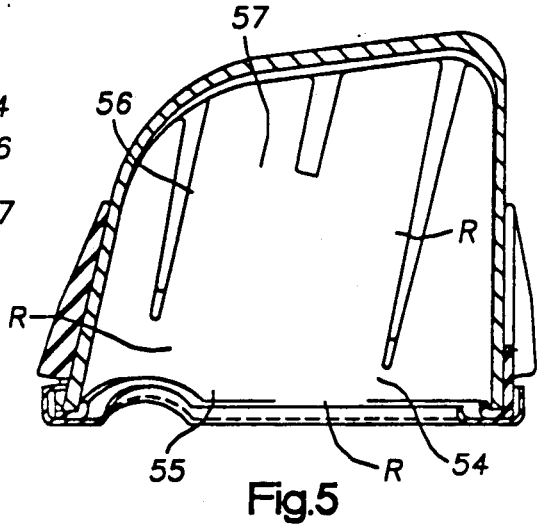
FIG. 5 is a view similar to FIG. 4 showing the brush roll in a second operational position.
Figure 6:
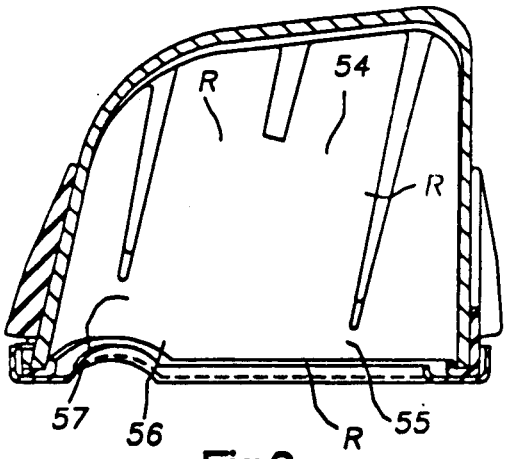
FIG. 6 is a view similar to FIG. 4 showing the brush roll assembly in a third operational position.
Figure 8:
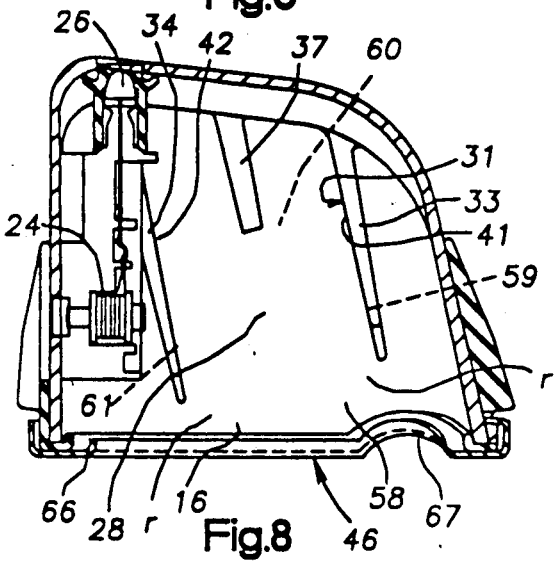
FIG. 8 is a view taken in the plane B-B of FIG. 3 showing an opposite end of the brush roll assembly in the first operational position.
Figure 9:
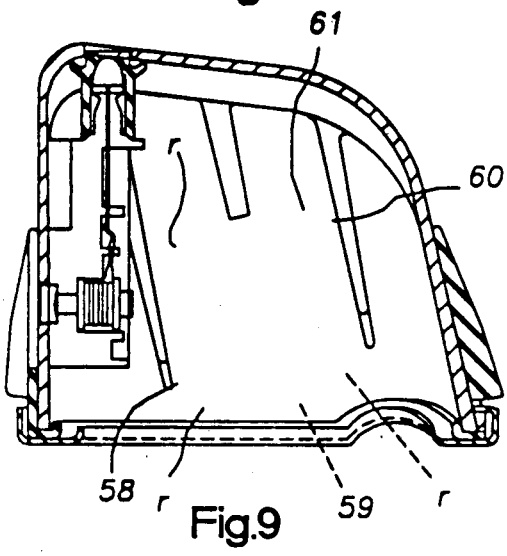
FIG. 9 is a view similar to FIG. 8 showing the brush roll assembly in the second operational position.
Figure 10:
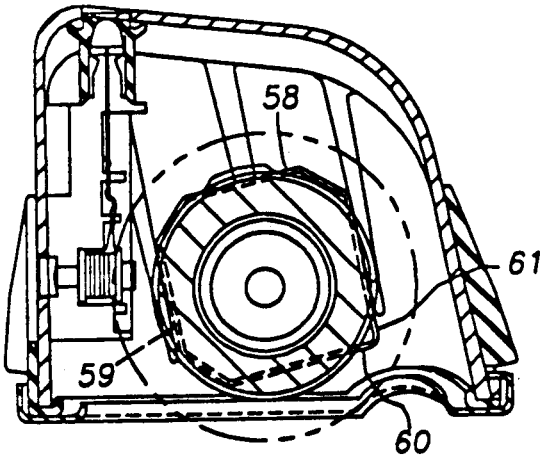
FIG. 10 is a view similar to FIG. 8 showing the brush roll assembly in a third operational position.

Each of the brush roll mounting blocks 16, 17 has a profile when viewed along the axis of the brush roll that is outlined or bounded by an imaginary profile square having side dimensions substantially equal to the spacing between its associated channel surfaces 41, 42 or 43, 44 less a slight clearance if desired to facilitate sliding assembly of the blocks 16, 17 in and out of their respective channels 31, 32. Each block 16, 17 receives and supports the shaft 28 with its axis and therefore the axis of the brush roll eccentrically of the geometric center of this imaginary profile square. The eccentricity is the same with both blocks 16, 17. Preferably, for each block this eccentricity exists in two coordinates such that the brush roll axis is displaced from each of two lines bisecting opposing sides of each imaginary profile square. For reasons set out below, the blocks 16, 17 are assigned three operating angular orientations corresponding to three sides 54–56 and 58–60 with a fourth non-used position corresponding to a fourth side 57, 61. In the illustrated example, the eccentricity places the axis of the brush roll 14 closest to the block sides 56 and 60. Indicia 51 in the form of one, two and three marks can be placed on skirts 52, 53 fixed to the blocks 16, 17 (FIGS. 2, 12*a* and 12*b*) to assist the user in selecting a desired setting. The indicia 51 alternatively can be placed directly on the sides 54–56 and 58–60 of the blocks 16, 17 if desired. The indicia 51 of a selected brush roll setting will be exposed to view at the open or lower side of the receiving channels 31, 32, that is, can be seen looking through the open face or bottom plane 46 of the rug nozzle. In the illustrated example, a single mark represents an initial position where the brush is new, the condition shown in FIGS. 4 and 8. The two-mark position corresponds to a brush having moderate wear (FIGS. 5 and 9) and the three-mark position corresponds to a brush having advanced bristle wear (FIGS. 6 and 10).

During normal operation, the mounting blocks 16, 17 are retained and located in abutting engagement with their associated stop bars 37, 38 and rearward parallel bars 34, 36 by tension forces in the drive belt in a known manner. The brush roll assembly 13 can be adjusted by the user of the vacuum cleaner without the use of tools. The drive belt is released from the motor shaft by a mechanism such as shown in U.S. Pat. No. 3,646,632. A rug plate 66 suitably retained on the rug nozzle 11 bY pivotal clips known in the art maintains the blocks in their respective channels 31, 32. With the belt released and the rug plate 66 removed or loosened, the user can conveniently adjust the vertical height of the brush roll assembly without tools by removing the blocks 16, 17 from their associated channels 31, 32 and repositioning them in an appropriate orientation. The rug plate 66 and belt can then be reinstalled to retain the brush roll assembly 13 in its selected position.

Figure 7:
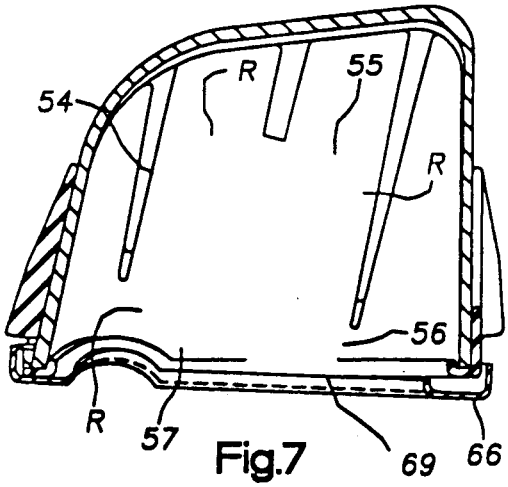
FIG. 7 is a view similar to FIG. 4 showing the brush roll assembly in a fourth unused position.
Figure 11:
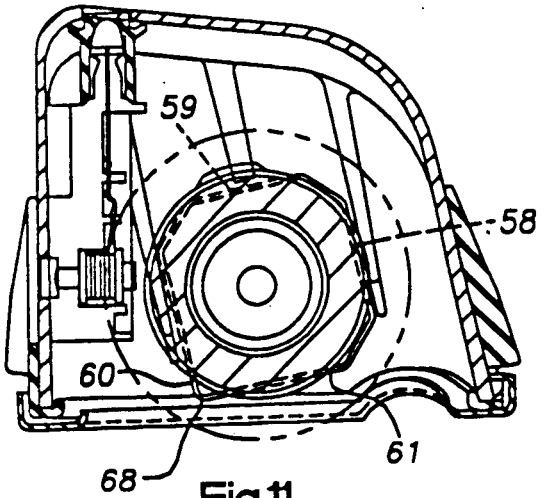
FIG. 11 is a view similar to FIG. 8 showing the brush roll assembly in the non-used position.

In general, it is desirable to maintain the circular path of the magnet 22 on the periphery of the brush roll body 18 relatively close to the sensor 24 for reliable sensor operation. The unused position of the blocks 16, 17, because of geometric considerations, does not afford a vertical position for the brush roll 14 that is materially different from that of position No. 2 (FIGS. 5 and 9). On the other hand, in this unused position, (FIGS. 7, 11) the path of the magnet 22 is substantially closer to the sensor 24 than it is in position No. 2. The present invention, in certain respects, takes these conditions into account and contemplates that the various components are proportioned so that in the unused position (FIGS. 7, 11) the magnet sweeps relatively close to the sensor for example, within 0.018 inch. This has the result of effectively reducing the distance of the path of the magnet 22 from the sensor 24 in the other positions 1-3 for reliable sensor operation. Since the brush roll height of the unused position is essentially redundant with position No. 2 there is no loss of adjustability but, advantageously, the risk of interference between the magnet 22 and sensor 24 is avoided since this position is not used. The risk of such interference increases where wear exists in the brush roll bearing surfaces.

The mounting blocks 16, 17 are preferably constructed of a non-metallic material such as rubber or plastic to absorb noise generated by rotation of the brush roll 14. The sound absorbing capacity, physical strength and durability of these blocks 16, 17 is increased where they are relatively large in comparison, for example, to the outside diameter of the brush roll as formed by the bristles 19. In one application of the invention, the large mounting block 17 has its sides bounded by an imaginarY square having side dimensions of 1.5 inch while the small block has its sides bounded by a 1.3 inch imaginary square. The brush roll outside diameter of the bristles, when new, is approximately 2-1/8 to 2-3/16 inches. Additionally, relatively large mounting blocks are generally easier to manipulate and locate in the receiving channels, 31, 32. However, relatively large mounting blocks present a potential problem of impeding air flow at the edge areas (right and left with reference to the user when operating the cleaner) of the nozzle. The present invention overcomes this apparent dilemma between relatively large mounting blocks and unimpeded nozzle edge cleaning air flow. With reference to FIGS. 4-6 and 8-10, the mounting blocks 16, 17 have their sides truncated or relieved at certain locations R, r. This relief R, r enables the blocks 16, 17 to be tilted with the receiving channels 31, 32 so that a forward area of each side 54-56 and 58-60 of the blocks 16, 17 is elevated from the plane of the lower face 46 of the rug nozzle. This elevation of the block sides 54-56 and 58-60 allows relatively free flow of air through nozzle edge vents 67 formed in adjacent sidewall areas of the rug nozzle 11 under the blocks. As shown, the block sides, particularly in the case of the larger block 17, actually extend over a portion of the flow path of air through these edge vents 67.

The side 57, 61 of each block 16, 17 corresponding to the unused position has no relief area and, advantageously, the relevant corners 68, 69 of the block profiles would occupy points that interfere with the rug plate 66. Consequently, if the brush roll assembly 13 is inadvertently installed in the excluded or non-used position of FIGS. 7, 11, the rug plate 66 cannot be installed and the user will be alerted to the mistake.

Air flow for edge cleaning is particularly important at the side of a nozzle associated with the magnet 22 and sensor 24 since bristles 19 are absent in the axial zone of the brush roll 14 associated with these elements. The mounting block 16 at this end of the brush roll assemblY is smaller than the mounting block 17 at the opposite end to increase air circulation and thereby offset any loss of cleaning efficiency due to the local absence of bristles. This smaller mounting block 16 is proportioned such that the size of the imaginary square at its boundaries has a side length less than the maximum diameter of the path swept by magnet 22 as the roll 14 rotates. As previously discussed, the differential in size of the blocks also prevents the brush roll 14 from being misassembled in the nozzle. The blocks 16, 17 are proportioned so that in each operational position a portion of a side 54-56 and 58-60 that corresponds with the imaginary square profile of the relevant block abuts the center bar or stop 37, 38 of the channel 31, 32. As compared to the ordinary prior art arrangements, the blocks 16, 17 are relatively large in relation to the diameter of the brush roll 14. In the illustrated embodiment, for example, the sides of the imaginary profile square outlining the shape of the large block 17 are such that the corner or corners formed thereby would extend radially outward substantially to the outer diameter of the bristles 19 when the brush is new (FIG. 4, lower left quadrant of imaginary square profile at point 71) and substantially all of the corners of the imaginarY square would extend beyond the brush roll diameter at a point of moderate wear (as indicated in FIG. 5).

Figure 3:
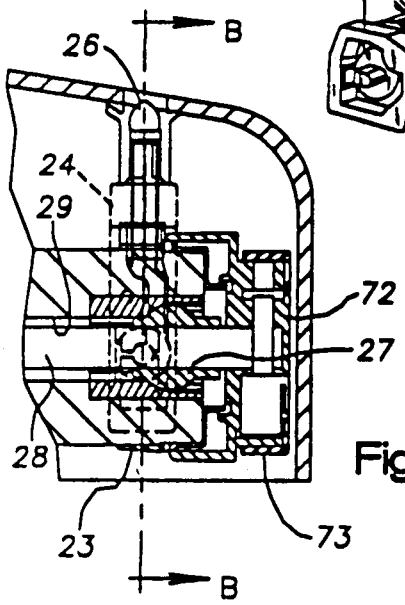
FIG. 3 is a fragmentary view, partially in section, taken in the plane 3—3 of FIG. 1 of the rug nozzle of the vacuum cleaner.

As indicated in FIG. 3, the illustrated block 16 is in the form of an elastomeric cover 73 of plastic or rubber that encases a metal end cap 72. The block 17 at the opposite end of the brush roll assembly 13 has a similar construction. It will be understood that various other constructions may be used in the practice of the invention. For example, the equivalent of the elastomeric cover and end cap can be made as an integral unit. Further, conventional bearing support structures for the brush roll body 18 different than that illustrated can be mounted in or on mounting blocks constructed in accordance with the invention. Such equivalents can include constructions where the blocks are not locked angularly together through a central shaft 28.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

I claim:

1. A brush roll assembly for an upright vacuum cleaner having a hollow rug nozzle adapted to receive a two-ended brush roll and a drive shaft and a drive belt for rotating the brush roll comprising a rigid roll body elongated in an axial direction and having bristles on an exterior of the body extending in a generally radial direction, the body including a cylindrical portion at its mid-length for receiving the belt in a friction drive relationship, bearing means at each end of the roll supporting the roll for rotation about its axis, a magnet adjacent one end of the roll body for energizing a sensing device in an associated end of the nozzle responsive to rotation of the magnet with the roll, mounting block means at each end of the roll body for reception in associated mounting block receivers in an interior of the nozzle, the mounting block means being arranged to support the roll body at multiple selectable positions, the positions being selected by orientation of the mounting block means in the nozzle receivers, the mounting block means at the end of the roll body associated with the magnet being smaller than the mounting block means associated with the opposite end of the roll body, the mounting block means having dimensions visually perceptively different from one another, the smaller mounting block means being adapted to be received in a receiving area in the nozzle closely sized to the smaller mounting block means and too small to receive the larger mounting block means whereby the brush roll assembly can only be assembled in the nozzle in a proper endwise orientation and whereby cleaning air flow is relatively unrestricted in areas within a nozzle outboard of the magnet.

2. A brush roll assembly as set forth in claim 1, wherein the smaller mounting block means has a polygonal profile and a side length of the polygonal profile is less than an outer diameter of a sweep of the magnet.

3. A brush roll assembly as set forth in claim 1, wherein each mounting block means has a polygonal profile, said mounting block means being arranged to support the roll body for rotation about its axis at associated points eccentric to the geometric center of their respective polygonal profiles.

4. A brush roll assembly as set forth in claim 1, wherein said mounting block means are at least partially constructed of a non-metallic material of rubber or plastic to reduce noise of operation.

5. A brush roll assembly as set forth in claim 3, wherein said mounting block means are arranged to be received in the nozzle in four different orientations corresponding to four sides of their respective polygonal profiles.

6. A brush roll assembly as set forth in claim 3, including indicia carried thereon indicating the eccentricity associated with each mounting block side when such each side faces downwardly when installed on the nozzle.

7. A brush roll assembly for an upright vacuum cleaner having a hollow rug nozzle adapted to receive a two-ended brush roll and a drive shaft and a drive belt for rotating said brush roll, said brush roll assembly comprising:

a rigid roll body elongated in an axial direction and having bristles on an exterior of said body extending in a generally radial direction, said body including:

a cylindrical portion of its mid-length for receiving said belt in a friction drive relationship;

a bearing means at each end of said roll supporting the roll for rotation about its axis;

a magnet adjacent one end of said roll body for energizing a sensing device in an associated end of said nozzle responsive to rotation of said magnet with said roll;

a mounting block means at each end of said roll body for reception in associated mounting block receivers in an interior of said nozzle, each mounting block means has a polygonal profile, said mounting block means being arranged to support said roll body at multiple selectable positions, the positions being selected by orientation of said mounting block means in said nozzle mounting block receivers, said mounting block means being arranged to support the roll body for rotation about its axis at associated points within their respective polygons, said mounting block means comprising:

one mounting block means at the end of said roll body associated with said magnet being smaller than the mounting block means associated with the opposite end of the roll body, the mounting block means having dimensions visually perceptively different from one another, the smaller mounting block means being adapted to be received in a receiving area in said nozzle closely sized to said smaller mounting block means and too small to receive said larger mounting block means thereby allowing said brush roll assembly to only be assembled in said nozzle in a proper endwise orientation and also allowing cleaning airflow to be relatively unrestricted in the area of said nozzle associated with said magnet;

the larger mounting block means has a configuration in axial profile that has at least one corner extending radially from the axis of the roll body substantially at least as far as the radial extent of said bristles, said larger mounting block means having a profile with at least two of its sides canted whereby said larger mounting block means can be supported in a rearwardly tilted position in the nozzle to provide clearance for air flow through an underlying edge vent in an associated side of the rug nozzle.

8. A brush roll assembly for an upright vacuum cleaner having a hollow rug nozzle adapted to receive a two-ended brush roll and a drive shaft and a drive belt for rotating said brush roll, said brush roll assembly comprising:

a rigid roll body elongated in an axial direction and having bristles on an exterior of said body extending in a generally radial direction, said body including:

a cylindrical portion of its mid-length for receiving said belt in a friction drive relationship;

a bearing mans at each end of said roll supporting the roll for rotation about its axis;

a magnet adjacent one end of said roll body for energizing a sensing device in an associated end of said nozzle responsive to rotation of said magnet with said roll;

a mounting block means at each end of said roll body for reception in associated mounting block receivers in an interior of said nozzle, each mounting block means has a polygonal profile, said mounting block means being arranged to support said roll body at multiple selectable positions, the positions being selected by orientation of said mounting block means in said nozzle mounting block receivers, said mounting block means being arranged to support the roll body for rotation about its axis at associated points within their respective polygonal profiles, said mounting block means are arranged to be received in the nozzle in four different orientations corresponding to four sides of their respective polygonal profiles, the mounting block means in one of the four positions is adapted to support the roll body in a position closer to a rear of the rug nozzle than the other of said positions such that the magnet sweeps relatively close to a stationary sensor in the rear of the rug nozzle, the larger mounting block means having one side of its profile, when in said one position, extending lower than the other of its sides extend in other positions whereby such one extending side indicates by its projection that such position is improper, said mounting block means comprising:

one mounting block means at the end of said roll body associated with said magnet being smaller than the mounting block means associated with the opposite end of the roll body, the mounting block means having dimensions visually perceptively different from one another, the smaller mounting block means being adapted to be received in a receiving area in said nozzle closely sized to said smaller mounting block means and too small to receive said layer mounting block means thereby allowing said brush roll assembly to only be assembled in said nozzle in a proper endwise orientation and also allowing cleaning airflow to be relatively unrestricted in the area of said nozzle associated with said magnet.

9. A brush roll assembly for an upright vacuum cleaner having a hollow rug nozzle adapted to receive a two-ended brush roll and a drive shaft and a drive belt for rotating said brush roll, said brush roll assembly comprising:

a rigid roll body elongated in an axial direction and having bristles on an exterior of said body extending in a generally radial direction, said body including:

a cylindrical portion of its mid-length for receiving said belt in a friction drive relationship;

a bearing means at each end of said roll supporting the roll for rotation about its axis;

a mounting block means at each end of said roll body for reception in associated mounting block receivers in an interior of said nozzle, said mounting block means being arranged to support said roll body at multiple selectable positions, the positions being selected by orientation of said mounting block means in said nozzle mounting block receivers, said mounting block means comprising:

one mounting block means having a smaller total perimeter than the mounting block means associated with the opposite end of said roll body, said smaller mounting block means being adapted to be received in a receiving area in said nozzle closely sized to said smaller mounting block means and too small to receive said larger mounting block means thereby allowing said brush roll assembly to only be assembled in said nozzle in a proper endwise orientation and also allow cleaning airflow to be relatively unrestricted in the area of said nozzle.

10. A brush roll assembly as set forth in claim 9 wherein the small mounting block means has a polygonal profile, a magnet for energizing a sensing device in an associated end of the nozzle responsive to rotation of the magnet with the roll, and a side length of the polygonal profile which is less than an outer diameter of a sweep of said magnet.

11. A brush roll assembly as set forth in claim 9, wherein each mounting block means has a polygonal profile, said mounting block means being arranged to support said roll body for rotation about its axis at associated points within their respective polygonal profiles.

12. A brush roll assembly as set forth in claim 9, wherein said mounting block means are at least partially constructed of a non-metallic material of rubber or plastic or any other generally resilient material, to reduce noise of operation.

13. A brush roll assembly as set forth in claim 11, wherein the larger said mounting block means has a polygonal profile that has at least one corner extending radially from the axis of said roll body substantially at least as far as the radial extend of said bristles, said larger mounting block means having a polygonal profile whereby said larger mounting block means is supported in a rearwardly tilted position in said nozzle to provide clearance for air flow through an underlying edge vent in associated side of said rug nozzle.

14. A brush roll assembly as set forth in claim 11, wherein said mounting block means are arranged to be received in said nozzle in four different orientations.

15. A brush roll assembly as set forth in claim 14, wherein said mounting block means, in one of said four positions is adapted to support said roll body in a position closer to a rear of aid rug nozzle than the other end of said positions, said larger mounting block means having one side of its profile, when in said one position, extending lower than the other of its sides extended in other positions whereby such one extending side indicates by its projection that such position is improper.

16. A brush roll assembly as set forth in claim 11, including indicia carried thereon indicating the position associated with each mounting block side when each such side faces downwardly when installed on said nozzle.

17. A brush roll assembly for a vacuum cleaner having a hollow rug nozzle adapted to receive a two-ended brush roll, the brush roll comprising:

(a) a rigid roll body elongated in an axial direction and having bristles on an exterior;

(b) mounting block means at each end of the roll body for mounting the roll body in the rug nozzle at multiple selectable positions, one mounting block means being smaller than the mounting block means associated with the opposite end of the roll body;

(c) bearings at each end of the roll journaling the mounting block means on the roll and supporting the roll for rotation about its axis;

(d) receivers in the rug nozzle to receive the mounting block means which correspond to the two sizes of the mounting block means thereby allowing for the roll body to only be mounted in the rug nozzle in one correct end to end orientation.

18. A brush roll assembly for a vacuum cleaner having a hollow rug nozzle adapted to receive a two-ended brush roll, the brush roll comprising:

(a) a rigid roll body elongated in an axial direction and having bristles on an exterior;

(b) mounting block means at each end of the roll body for mounting the roll body in the rug nozzle at multiple selectable positions, one mounting block means being smaller than the mounting block means associated with the opposite end of the roll body;

(c) bearing at each end of the roll journaling the mounting block means on the roll and supporting the roll for rotation about its axis;

(d) receivers in the rug nozzle to receive the mounting block means which correspond to the two sizes of the mounting block means, the receivers being canted such that the mounting block means are tilted rearwardly allowing for air flow with minimal obstruction and strong bearing support.

19. A brush roll assembly for a vacuum cleaner having a hollow rug nozzle adapted to receive a two-ended brush roll, the brush roll comprising:

(a) a rigid roll body elongated in an axial direction and having bristles on an exterior;

(b) mounting block means at each end of the roll body for mounting the roll body in the rug nozzle at multiple selectable positions, one mounting block means being smaller than the mounting block means associated with the opposite end of the roll body;

(c) bearing at each end of the roll journaling the mounting block means on the roll and supporting the roll for rotation about its axis;

(d) receivers in the rug nozzle to receive the mounting block means which correspond to the two sizes of the mounting block means, the mounting block means are arranged to be received into the receivers in at least three different orientations without adjustment of the nozzle or the use of tools and in such a way that it is impossible to mix orientations or incorrectly mount the roll body.

20. A brush roll assembly for a vacuum cleaner having a hollow rug nozzle adapted to receive a two-ended brush roll, the brush roll comprising:

(a) a rigid roll body elongated in an axial direction and having bristles on an exterior;

(b) mounting block means at each end of the roll body for mounting the roll body in the rug nozzle at multiple selectable positions, one mounting block means being smaller than the mounting block means associated with the opposite end of the roll body;

(c) bearings at each end of the roll journaling the mounting block means on the roll and supporting the roll for rotation about its axis;

(d) receivers in the rug nozzle to receive the mounting block means which correspond to the two sizes of the mounting block means, the mounting block mans are arranged to be received into the receivers in four different orientations whereby one of the orientations positions the mounting block means in such a way that one of the sides of the larger mounting block means extends into a position which indicates that this orientation is improper.

* * * * *